US005196646A

United States Patent [19]

Worsey

[11] Patent Number: 5,196,646

[45] Date of Patent: Mar. 23, 1993

[54] DUAL PURPOSE FUZE

[75] Inventor: Paul N. Worsey, Rolla, Mo.

[73] Assignee: Curators of the University of Missouri, Columbia, Mo.

[21] Appl. No.: 594,111

[22] Filed: Oct. 3, 1990

[51] Int. Cl.[5] ..... F42C 14/00; F42C 19/00; F42B 12/58

[52] U.S. Cl. ..... 102/293; 102/473; 102/499

[58] Field of Search ..... 102/293, 473, 476, 489, 102/499, 504, 505

[56] References Cited

U.S. PATENT DOCUMENTS

| | | | |
|---|---|---|---|
| 2,697,400 | 12/1954 | Liljegren | 102/476 |
| 2,741,180 | 4/1956 | Meister | 102/476 |
| 2,764,092 | 9/1956 | Massey | 102/476 |
| 3,451,339 | 6/1969 | Precoul | 102/56 |
| 3,563,178 | 2/1971 | Caples | 102/86.5 |
| 3,677,182 | 7/1972 | Peterson | 102/505 |
| 3,968,748 | 7/1976 | Burford et al. | 102/7.2 |
| 3,982,488 | 9/1976 | Rakowsky | 102/81 |
| 4,072,107 | 2/1978 | Saxe et al. | 102/4 |
| 4,471,696 | 9/1984 | Clayson | 102/293 |
| 4,615,271 | 10/1986 | Hutchinson | 102/318 |
| 4,982,665 | 1/1991 | Sewell et al. | 102/306 |

OTHER PUBLICATIONS

Title: Fluid Jet Impact Sensitivity Manual; Author: John K. Klesterman and Paul N. Worsey; Date: Jul. 1988; pp. 1, 2, 45-91 and 142-152.

*Primary Examiner*—Charles T. Jordan

*Attorney, Agent, or Firm*—Senniger, Powers, Leavitt & Roedel

[57] ABSTRACT

A dual purpose fuze for a projectile which can activate a quantity of material selected from a group including high explosive, low explosive, propellant and pyrotechnic compounds. The fuze includes a charge holder having a socket therein facing the quantity of material to be activated. A fuze charge located in the socket has a depression in it so formed as to cause the fuze charge to explode in a jet directed outwardly from the socket of sufficiently high energy to activate a high explosive in a high explosive projectile, the fuze charge being sufficiently small to prevent rupture of containment for a propellant in a cargo projectile. The fuze further includes mechanisms for arming and detonating the fuze charge as well as for activating detonation. A safety mechanism is provided to prevent premature detonation of the fuze charge.

16 Claims, 3 Drawing Sheets

DUAL PURPOSE FUZE

BACKGROUND OF THE INVENTION

This invention relates generally to fuzes for projectile ordnance and more particularly to a dual purpose fuze for activating any one of a variety of explosive and propellant materials of various sensitivities in the projectile.

Artillery projectiles of the same basic configuration may be used as bursting projectiles which carry high explosive to a target where it is detonated, or used as cargo projectiles which carry a cargo (e.g., mines, anti-personnel grenades, or the like) to a target where the cargo is deployed from the projectile. Heretofore, depending upon the particular application of the projectile, a different type of fuze was required. When the projectile carries high explosive the fuze must be sufficiently powerful to detonate the high explosive. However, in a cargo projectile, the fuze ignites propellant (or a low explosive) to eject the cargo from the projectile casing for deployment. In order to operate properly the containment of the propellant within the casing must be maintained in order to provide sufficient pressure to eject the cargo from the projectile casing. Thus, a fuze of a lesser explosive force is required to prevent rupture of the propellant containment by detonation of the fuze. However, such a fuze is not powerful enough to detonate high explosive. The requirement of two different types of fuzes for similar projectiles can lead to errors in arming the projectiles particularly under battlefield conditions. Supplementary charges may be provided to boost the fuze containing a lesser explosive charge. However, this requires additional inventory, more manipulation to arm the (high explosive) projectiles, and presents another opportunity for error.

Moreover, the fuzes for high explosive can themselves contain a relatively large amount of explosive. Handling of the fuzes presents a danger in that the inadvertent detonation of the fuze will by sufficiently violent as to be likely to cause severe injury or death to the person handling the fuze.

SUMMARY OF THE INVENTION

Among the several objects and features of the present invention may be noted the provision of a fuze which may be used both in high explosive and cargo projectiles; the provision of such a fuze which can detonate high explosive despite a gap between the fuze and the explosive; the provision of such a fuze which utilizes a minimum of explosive charge; the provision of such a fuze which reduces the danger in case of inadvertent fuze detonation; the provision of such a fuze which overdrives the detonation of an explosive or ignition of a propellant; the provision of such a fuze operable in existing artillery projectile designs; and the provision of such a fuze which is simple in design and economical to manufacture.

Further among the several objects and features of the present invention may be noted the provision of a projectile capable of carrying a variety of payload from high explosive to cargo which may be activated by a single type of fuze.

Still further among the several objects and features of the present invention may be noted the provision of a method for arming ordnance in which a projectile with a payload of high explosive or cargo may be armed with a single type of fuze.

Generally, a dual purpose fuze for a projectile, constructed according to the principles of the present invention includes a charge holder having a socket in it facing a quantity of material to be activated. The fuze is adapted to activate such a quantity of material selected from a group including high explosive, low explosive, propellant or pyrotechnic compounds. A fuze charge located in the socket has a depression in it which is formed to cause the fuze charge to explode in a jet directed outwardly from the socket of sufficiently high energy to activate a high explosive in a high explosive projectile. However, the fuze charge is sufficiently small to prevent rupture of containment for a propellant in a cargo projectile. Detonating means is provided for detonating the fuze charge and safety means is provided to prevent the premature detonation of the detonating means. Activating means activates the detonating means to detonate the fuze charge.

Generally, a projectile constructed according to the principles of the present invention comprises an outer casing and is adapted for carrying either a payload of high explosive or cargo and a quantity of propellant. The projectile has a quantity of material in it selected from a group including high explosive, low explosive, propellant and pyrotechnic compounds. The projectile further includes a dual purpose fuze of the type described above, which is shaped and configured for connection to the casing.

The method of the present invention generally involves the provision of a projectile containing a payload of high explosive and a projectile containing a payload of cargo and a quantity of propellant. A dual purpose fuze of the type described above is also provided for fitting into the projectile casing without regard to whether the projectile being armed contains high explosive or propellant.

Other objects and features of the present invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENTS

Figure 1:
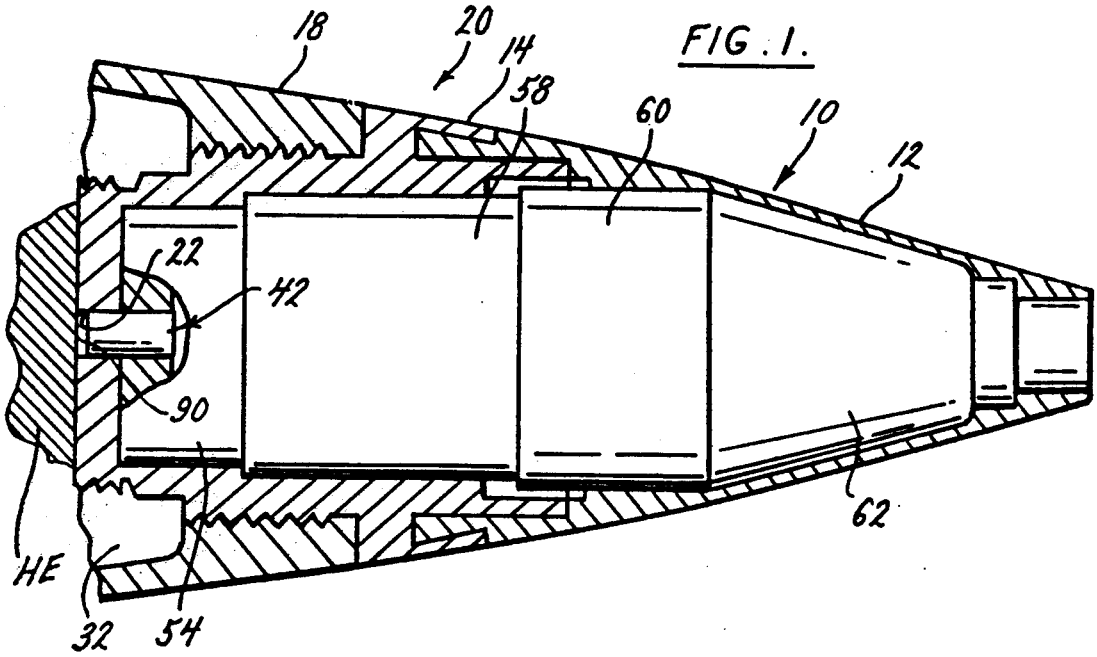
FIG. 1 is a fragmentary longitudinal section of a dual purpose fuze of the present invention as attached to a projectile.
Figure 4:
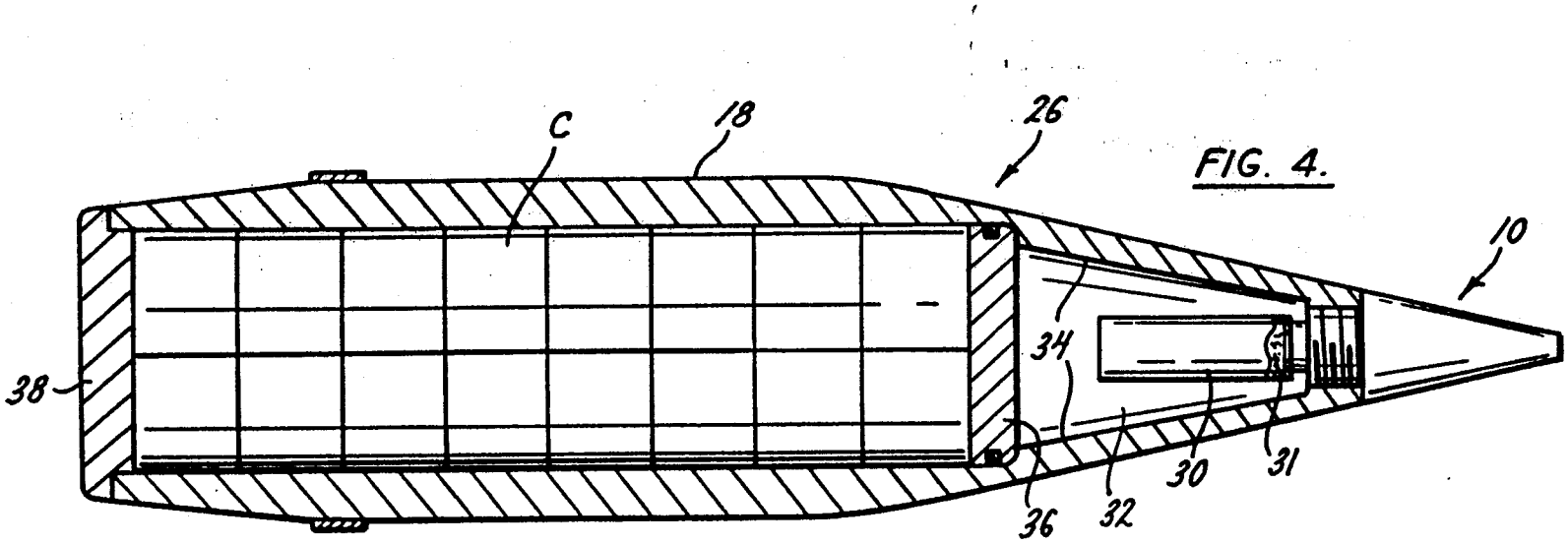
FIG. 4 is a longitudinal section of a cargo projectile.
Figure 5:
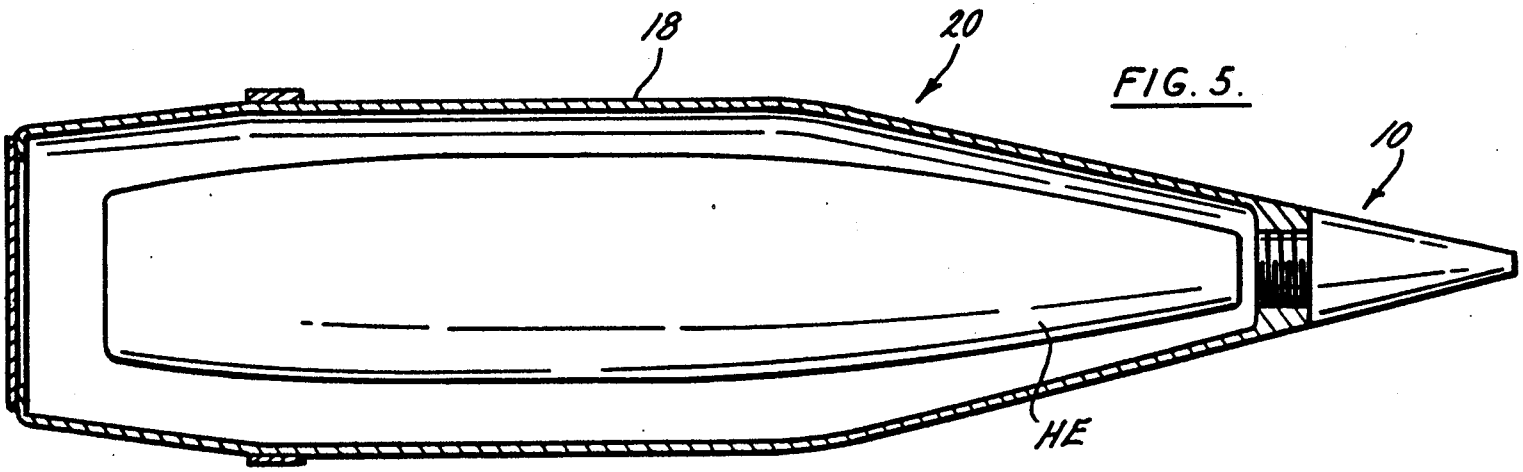
FIG. 5 is a longitudinal section of a high explosive projectile.

Referring now to the drawings, and in particular to FIG. 1, a dual purpose fuze of the present invention, indicated generally at 10, is shown to comprise a housing including a nose section 12 and a tail section 14 which are fitted together for housing the fuze components. The tail section 14 of the housing, as shown in FIG. 1, is screwed into casing 18 of a high explosive projectile 20 (such as is shown in FIG. 5), and an opening 22 in the end of the tail section 14 provides communication between the fuze 10 and the interior of the projectile casing, which contains a quantity of high explosive HE, such as Compositions A-5 or A-3, a PBXN, CH-6 or TNT, of the type commonly used in military bursting projectiles. Although not illustrated in the drawings, the high explosive is typically held in a steel jacket inside the casing 18 of the projectile 20. As shown in FIG. 4, a projectile 26 which is virtually identical to the high explosive projectile 20 may also carry cargo C (e.g., mines, anti-personnel grenades, or the like) which is to be deployed, rather than detonated at the target.

For the bursting projectile 20, detonation of the high explosive HE by the fuze 10 results in the projectile disintegrating into fragments for maximum destructive effect. In the cargo projectile 26, the fuze 10 communicates with a canister 30 containing a quantity of propellant 31. Detonation of the fuze charge 46 ignites the propellant 31 in an area of containment 32 defined by the interior wall 34 of the projectile casing 18 and a pusher plate 36 which separates the containment area from the cargo C. The rapid increase in pressure in the containment area 32 as the propellant burns drives the pusher plate 36 and cargo C rearwardly. A base plate 38, which is typically attached to the casing 18 by crimping the casing or a fastener (not shown) on the casing over the peripheral edges of the base plate, breaks away from the casing and the cargo C is ejected rearwardly of the casing. Thus, it is imperative for a cargo projectile 26 that the integrity of the containment area 32 be maintained after detonation of the fuze 10 so that the pressure may build up sufficiently to eject the cargo. A conventional fuze with enough charge to ignite the propellant, but which is small enough to avoid rupture of the containment area is not sufficiently powerful to detonate high explosive. However, the fuze 10 of the present invention can operate both in the cargo projectile 26, and in the high explosive projectile 20 without the addition of supplemental charges to augment its explosive force. It is to be understood that although the description refers to high explosive and cargo projectiles the principles of this invention are applicable to fuzes for activating explosives or propellants in other configurations.

Figure 2:
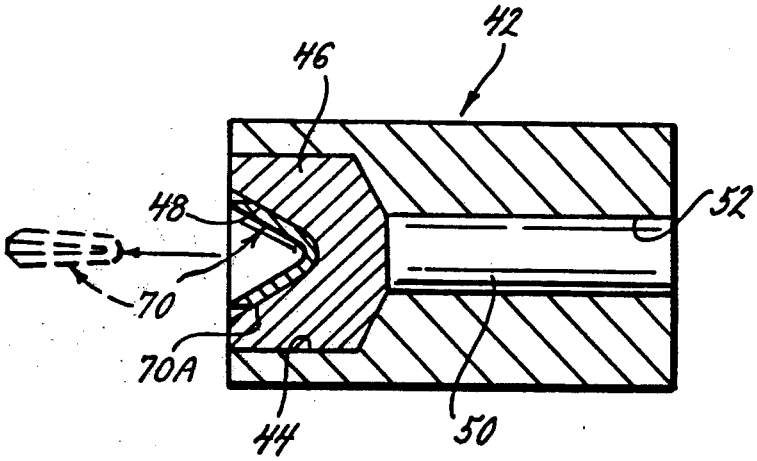
FIG. 2 is a longitudinal section of a fuze charge holder of the present invention.

A cylindrical fuze charge holder, indicated generally at 42, having a socket 44 in one end is located in the opening 22 adjacent the tail end of the fuze 10 with its socket facing the quantity of material (e.g., high explosive, low explosive, propellant or pyrotechnic compound) to be activated. As shown in FIG. 2, a fuze charge 46, which may be PBXN 5, PBXN 6, RDX, PETN, HNS or other standard fuze explosive, is located in the socket 44 and has a depression 48 in it facing outwardly of the socket which is generally symmetric with respect to the central axis of the socket. The fuze charge 46 is located at the end of the explosive train of the fuze 10. Means for detonating the fuze charge includes a first detonating member 50 located in a cylindrical passage 52 extending longitudinally of the charge holder 42 and communicating with the socket 44, and a detonation mechanism 54 in the tail section 14 of the housing. Safety means for preventing the premature detonation of the fuze and arming means for releasing the safety means to allow detonation of the fuze 10 are indicated at 58 and 60, respectively. At the nose of the fuze, means 62 is provided for activating the detonation means based upon impact, proximity, time or other desired activation criteria. The detonation means, safety means, arming means and activating means are illustrated diagrammatically because they are fuze components which are well know in the art of projectile fuzes.

A concave liner 70 made of a material having a high density, such as metal, is located in the fuze charge depression. The liner has a convex surface 70A which engages the fuze charge 46 and has a contour generally conforming to the shape of the depression 48. The liner 70 may vary in configuration from conical to hemispherical depending upon the performance required of the fuze 10. The shape of the depression 48 generally corresponds to the shape of the convex surface 70A of the fuze. The depression 48 shapes the fuze charge 46 so as to cause it to explode in a jet directly outwardly from the socket 44. Initiation of the fuze charge 46 from its right end (as viewed in FIG. 2) by the detonating member 50 produces an approximate wave detonation front moving to the left. As the wave progresses leftward along the liner 70, the sides of the liner collapse radially inwardly and it is hyper-accelerated out of the socket 44 generally along the axis of the socket in a cohesive manner, as shown in phantom in FIG. 2. The liner 70 along with the detonation wave form a jet of high velocity which focuses the energy of the fuze charge explosion generally along the axis of the socket 44. However, it is to be understood that in some configurations, such as when the fuze charge 46 and quantity of material to be activated are not separated by a gap, the fuze 10 of the present invention absent the liner 70 is capable of activating the material.

The majority of military high explosives presently in use have detonation velocities in the range of seven to eight kilometers per second. The velocity of the fuze charge jet can be in excess of ten kilometers per second, clearly higher than required to detonate the high explosive. Activation of the explosive or propellant by a jet at a velocity in excess of its detonation or ignition velocity results in "overdriving". Overdriving of the explosive or propellant causes the explosive or propellant to instantaneously reach their maximum theoretical performance levels (e.g., with a high explosive, the shock wave is created instantaneously upon detonation). Thus, the fuze 10 obtains the maximum performance of the quantity of material activated (whether propellant or explosive). In the future, more insensitive high explosives may be used to increase safety in handling the projectiles. In that event, it is believed that the fuze 10 of the present invention may be modified to include a plurality of small shaped fuze charges (not shown) sufficient to activate a critical area of the high explosive so that detonation reaction will be maintained once initiated by the fuze.

Figure 3:
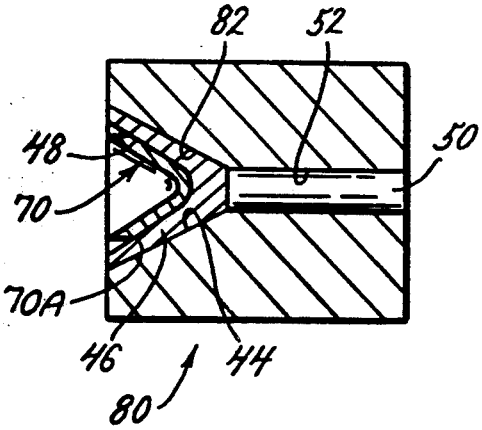
FIG. 3 is a longitudinal section of a fuze charge holder of a second embodiment.
Figure 2A:
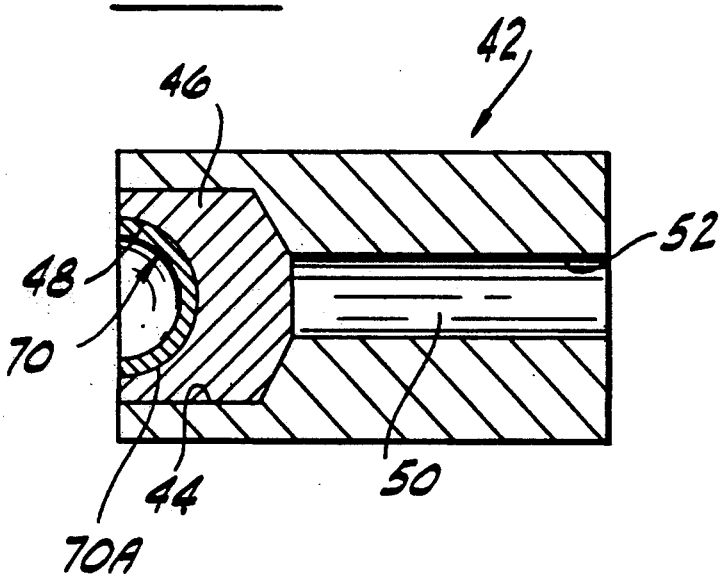
FIG. 2A is a longitudinal section of a fuze charge holder of a second embodiment of the present invention wherein the fuze charge and fuze charge liner are hemispherical.

The high jet velocities achieved by the shaped fuze charge 46 require only a minimal amount of explosive. It is believed that for those high explosives presently in use by the military, that a fuze charge of approximately 1 gram or less should be sufficient to detonate the high explosive without the aid of a supplemental charge. The charge holder 80 shown in FIG. 3 has been modified from that shown in FIG. 2 so that the walls of its socket 82 generally conform to the shape of the depression 48 in the fuze charge 46 and to the liner 70 configuration. The size of the socket 82 is also significantly reduced over that of the charge holder 42 of FIG. 2. Presently such supplemental or booster charges used to augment the fuze charge may have anywhere from 30 grams to over 200 grams of explosive, which makes the fuze a powerful explosive in its own right. The power of these supplemented fuzes greatly increases the likelihood of serious injury or death should the fuze inadvertently detonate while being handled.

The fuze charge jet from the detonation of the fuze charge 46 is also capable of detonating high explosive HE although a gap or "standoff" 90 between the fuze charge and the explosive is present (FIG. 1). The hyper-acceleration of the liner 70 by the shaped fuze charge converts the explosive energy of the fuze charge detonation into kinetic energy which propagates across the gap more readily than the detonation wave. The liner 70 allows the fuze charge jet to remain focused (i.e., having a high impact velocity over a small area after traveling a distance) over the standoff 90. The ability to activate the high explosive HE despite the standoff 90 between the fuze 10 and the high explosive is critical in fuze design for existing projectiles in which a standoff between the fuze and the high explosive in the high explosive projectile 20 is present to provide a space for a supplementary charge (not shown) to be added on to the fuze. Supplementary charges or boosters provide an additional weight of explosive to augment the explosive force of a conventional fuze for use in detonating high explosive.

An understanding of the method of arming ordnance of the present invention is facilitated by reference to FIGS. 4 and 5 which show the projectile 26 containing a payload of cargo C and a quantity of propellant (FIG. 4) and the projectile 20 containing a payload of high explosive (FIG. 5). The provision of a dual purpose fuze as describes above allows either of these projectiles to be armed by fitting the fuze into the projectile casing 18. Thus arming of the projectiles may be carried out without regard to the payload of the projectile. Moreover, the same fuze is operable to detonate the high explosive without the addition of a supplementary or booster charge.

Tests were conducted for the fuze charge 46 in which the amount of explosive used for the fuze charge was five to six grams of layered DETASHEET explosive formed with the conical depression 48 in the charge holder 42 shown in FIG. 2. More specifically, seven circular sheets where cut from a sheet of DETASHEET explosive, and inserted into the socket 44. A conical copper liner having a 60 degree interior cone angle, a mass of 1.16 ±0.01 grams, a thickness of 0.025 inches, a diameter of 0.5 inches and a height of 0.383 inches was selected for the tests. It is to be understood that the precise dimensions of the liner are not critical to the invention. The shaped fuze charge 46 was primed by inserting a detonator (e.g., first detonating member) into the passage 52 at the opposite end of the charge holder 42 from the socket 44. For most tests, Atlas ROCKMASTER detonators containing 0.6 grams PETN or RDX were used to fire the charge. However, for tests photographed with a high speed camera, Reynolds RP80 EBW's were used containing 200 milligrams of high explosive (PETN and RDX).

The fuze charges 46 were fired in an explosion chamber using spacers to provide standoff distances between the fuze charge and the target quantity of material to be activated by the fuze. Initially, tests were conducted without explosive targets to observe jet penetration into a two inch hot rolled steel witness plate (not shown) at different standoff distances. The maximum penetration depth was used as an approximate correlation to maximum impact pressure. These tests were conducted for a range of standoff distances from 0.25 to 3.7 inches. By plotting the depth of penetration into the witness plate against the standoff distance it was determined that the optimum standoff distance for maximum focusing and thus penetration of the shaped fuze charge jet with no explosive target is 1 inch. For tests with explosive or propellant targets, two witness plates (not shown) were used. One of the witness plates was solid, while the other was annular. The witness plates were arranged to prevent detonation of the target explosive by the impact of the jet from the fuze charge with the witness plate. More specifically, the annular plate was positioned immediately behind the target but in front of the solid witness plate with the target positioned in registration with the opening in the annular plate. Therefore, the jet produced by the fuze charge detonation dissipated in the gap between the target and the solid witness plate prior to impact with the solid plate. The explosive test targets included 27 gram Composition A-5 pellets, 135 gram TNT T-2 supplemental charges in aluminum cases, M10 propellant and PYRODEX, a black powder substitute. Of the Composition A-5 explosive targets, detonation of the target with the shaped fuze charge was achieved up to and including a standoff distance of 2.5 inches. The only Composition A-5 target which failed to detonate (Test 13) was at a standoff of 2.5 inches. On examination, the cause was determined to be misfiring of the fuze charge, probably because the detonator was not in proper contact with the fuze charge explosive. For the T-2 supplemental charge targets, detonation was achieved up to a standoff distance of 0.25 inches. In both cases the shaped fuze charge performed satisfactorily over standoff distances in excess of those encountered in existing projectiles.

For the propellant targets, slightly different testing apparatus (not shown) was employed. The PYRODEX was placed in a plastic bag on top of a 7.5 inch length of 2.5 inch diameter aluminum tubing with a 0.052 inch layer of lead over a 1 inch hot rolled steel witness plate. When impacted by the shaped fuze charge jet, the PYRODEX burned but did not detonate, as would be required of a propellant. The tests using the M10 propellant were conducted with the propellant filling the interior of the annular witness plate up to a plane level with the upper surface of the annular witness plate. This arrangement prevented undesirable disbursement of the propellant by the fuze charge jet. The results of the tests are shown below in tabular form.

| Test | Target | Standoff | Detonator | Chg. Wt. | Detonation | Penetration |
|---|---|---|---|---|---|---|
| 1 | WP | 0.25(in.) | Rockmaster | 6.20(g) | N/A | 0.672(in.) |
| 2 | " | 0.5 | Rockmaster | 5.54 | N/A | 1.116 |
| 5 | " | 1.0 | Rockmaster | 5.47 | N/A | 1.299 |
| 21 | " | 1.5 | Rockmaster | 4.97 | N/A | 1.184 |
| 7 | " | 2.0 | Rockmaster | 5.24 | N/A | 1.107 |
| 22 | " | 2.75 | Rockmaster | 5.04 | N/A | 1.019 |
| 10 | " | 3.7 | Rockmaster | 5.24 | N/A | 0.62 |
| 3 | A-5(27 g) | 0.5 | Rock- | 5.64 | Yes | 0.416 |

-continued

| Test | Target | Standoff | Detonator | Chg. Wt. | Detonation | Penetration |
|---|---|---|---|---|---|---|
| | | | master | | | |
| 4 | " | 0.5 | Rock-master | 5.45 | Yes | 0.175 |
| 6 | " | 1.0 | Rock-master | 6.00 | Yes | 0.1055 |
| 8 | " | 2.0 | Rock-master | 5.26 | Yes | 0.1045 |
| 13 | " | 2.5 | Rock-master | 5.79 | No | 0. |
| 14 | " | 2.5 | RP-80 | 5.76 | Yes | 0.127 |
| 11 | T-2(135 g) | 0.1 | Rock-master | 5.22 | Yes | 0.2165 |
| 12 | " | 0.25 | Rock-master | 5.46 | Yes | 0.2485 |
| 30 | " | 0.35 | Rock-master | 5.41 | No | 0. |
| 29 | " | 0.5 | Rock-master | 5.23 | No | 0. |
| 9 | Pyrodex | 0.75 | Rock-master | 5.25 | No | 0. |
| 18 | M10(30 g) | 1.0 | RP-80 | 5.08 | No | 0.591 |
| 19 | " | 2.0 | " | 4.97 | No | 0.278 |

In view of the above, it will be seen that the several objects of the invention are achieved and other advantageous results attained.

As various changes could be made in the above constructions without departing from the scope of the invention, description or shown in the accompanying drawings shall be interpreted as illustrative and not in a limiting sense.

What is claimed is:

1. A projectile comprising:

an outer casing;

a quantity of material to be activated in the casing, the material being selected from a group including high explosive, low explosive, propellant and pyrotechnic compounds, the projectile being capable of carrying the quantity of material as its payload and for carrying cargo as its payload;

a dual purpose fuze having a housing shaped and configured for connection to the outer casing, the fuze being capable of activating any of the materials in said group of materials, the fuze comprising:

a fuze charge located in the socket having a depression therein;

means for detonating the fuze charge;

safety means for preventing premature detonation of the fuze;

arming means for releasing said safety means to allow detonation of the fuze; and means for activating said detonating means thereby to detonate the fuze charge, the depression being formed to cause the fuze charge to explode in a jet directed outwardly from the socket of sufficiently high energy to activate a high explosive in a high explosive projectile, the fuze charge being sufficiently small to prevent rupture of containment for a propellant in a cargo projectile.

2. A projectile as set forth in claim 1 wherein the fuze further comprises a concave liner located generally in the depression in the fuze charge, the liner having a convex surface engaging the fuze charge and having a contour generally conforming to the shape of the depression.

3. A projectile as set forth in claim 2 wherein the fuze liner is made of metal, the liner being adapted to collapse radially inwardly upon detonation of the fuze charge and to be propelled out of the socket into the quantity of material to be activated.

4. A projectile as set forth in claim 3 wherein the fuze liner is generally conical in shape.

5. A projectile as set forth in claim 3 wherein the fuze liner is generally hemispherical in shape.

6. A projectile as set forth in claim 2 wherein the depression in the fuze charge of the fuze is generally symmetric about a central axis of the socket.

7. A projectile as set forth in claim 6 wherein the depression is generally conical in shape.

8. A projectile as set forth in claim 2 wherein the amount of the fuze charge of the fuze is less than one gram.

9. A projectile as set forth in claim 2 wherein the amount of the fuze charge is less than five grams.

10. A projectile as set forth in claim 2 wherein the fuze is capable of activating the quantity of material in an overdriven mode.

11. A projectile as set forth in claim 2 wherein the charge holder has a passage therein communicating with the socket, and wherein said detonating means comprises a first detonating member disposed generally in the passage.

12. A projectile as set forth in claim 1 wherein the quantity of material is selected from group including low explosive and propellant, and wherein the payload is cargo arranged in the casing for disbursement from the casing upon detonation of the quantity of material.

13. A projectile as set forth in claim 1 wherein the quantity of material is spaced from the fuze charge in a range from approximately 0.25 inch to 2.5 inches.

14. A method for arming ordnance comprising the steps of:

providing a projectile including a casing containing a payload of high explosive;

providing a projectile including a casing containing a payload of cargo and a quantity of propellant;

providing a dual purpose fuze capable of activating high explosive and propellant, the fuze including a charge holder having a socket therein facing the quantity of high explosive or propellant to be activated, a fuze charge located in the socket having a depression therein, means for detonating the fuze charge, a concave liner located generally in the depression in the fuze charge, the liner having a convex surface engaging the fuze charge and having a contour generally conforming to the shape of the depression, and means for activating said detonating means, the depression in the fuze charge forming upon detonation a jet directed outwardly through the opening of sufficiently high energy to activate the high explosive, and fitting the fuze into the projectile casing without regard to whether the projectile being armed contains high explosive or propellant, said fuze being capable of either activating the high explosive or activating the propellant without rupture of the projectile casing.

15. In combination, first and second fuzes and first and second projectiles, the first projectile having a payload of high explosive and the second projectile having a payload of cargo and propellant, the fuzes each comprising:

a charge holder having a socket therein facing a quantity of material to be activated;

a fuze charge located in the socket having a depression therein, the fuze charge in each fuze being a the same material and quantity;

means for detonating the fuze charge;

safety means for preventing premature detonation of the fuze;

arming means for releasing said safety means to allow detonation of the fuze; and means for activating said detonating means thereby to detonate the fuze charge, the depression being formed to cause the fuze charge to explode in a jet directed outwardly from the socket;

the first fuze being adapted for reception in the first projectile and to directly detonate the high explosive upon detonation of the fuze charge, and the second fuze being adapted for reception in the second projectile and to directly ignite the propellant without rupture of containment for the propellant upon detonation of the fuze charge.

16. A dual purpose fuze in combination with a first projectile and a second projectile, the first projectile having a payload of high explosive and the second projectile having a payload of cargo and propellant, the fuze comprising:

a charge holder having a socket therein facing a quantity of material to be activated;

a fuze charge located in the socket having a depression therein;

means for detonating the fuze charge;

safety means for preventing premature detonation of the fuze;

arming means for releasing said safety means to allow detonation of the fuze; and means for activating said detonating means thereby to detonate the fuze charge, the depression being formed to cause the fuze charge to explode in a jet directed outwardly from the socket;

the fuze being adapted to be selectively fitted into the first projectile for directly detonating the high explosive upon detonation of the fuze charge, or into the second projectile for directly igniting the propellant, without rupture of containment for the propellant upon detonation of the fuze charge.

* * * * *

UNITED STATES PATENT AND TRADEMARK OFFICE

CERTIFICATE OF CORRECTION

PATENT NO. : 5,196,646

DATED : March 23, 1993

INVENTOR(S) : Paul N. Worsey

It is certified that error appears in the above-identified patent and that said Letters Patent is hereby corrected as shown below:

Column 7, claim 1, lines 44-45, "comprising: a fuze", should read ---comprising: a charge holder having a socket therein facing the quantity of material to be activated; a fuze---.

Column 9, claim 15, lines 2-3, "being a the same", should read ---being of the same---.

Signed and Sealed this

Fourth Day of January, 1994

*Attest:*

*Attesting Officer*

BRUCE LEHMAN

*Commissioner of Patents and Trademarks*